US006729232B2

(12) United States Patent
Langsch

(10) Patent No.: US 6,729,232 B2
(45) Date of Patent: May 4, 2004

(54) FLUID-COATED FANOUT COMPENSATOR

(75) Inventor: Robert Langsch, Ortschwaben (CH)

(73) Assignee: Maschinenfabrik Wifag, Bern (CH)

( * ) Notice: Subject to any disclaimer, the term of this patent is extended or adjusted under 35 U.S.C. 154(b) by 0 days.

(21) Appl. No.: 10/455,073

(22) Filed: Jun. 5, 2003

(65) Prior Publication Data

US 2003/0226459 A1 Dec. 11, 2003

(30) Foreign Application Priority Data

Jun. 6, 2002 (DE) ..... 102 25 199

(51) Int. Cl.[7] ..... B41F 13/02
(52) U.S. Cl. ..... 101/219; 101/216; 101/232
(58) Field of Search ..... 101/216, 232, 101/219

(56) References Cited

U.S. PATENT DOCUMENTS 4,696,230 A * 9/1987 Barkley ..... 101/181
5,347,928 A * 9/1994 Ito ..... 101/415.1
5,365,847 A * 11/1994 Pers ..... 101/248
5,699,735 A * 12/1997 Stein et al. ..... 101/219
5,970,870 A * 10/1999 Shiba et al. ..... 101/137
6,082,261 A * 7/2000 Richards ..... 101/378
6,186,064 B1 * 2/2001 Dufour ..... 101/181
6,550,384 B1 * 4/2003 Langsch ..... 101/225
6,553,908 B1 * 4/2003 Richards et al. ..... 101/248

FOREIGN PATENT DOCUMENTS

EP 1 101 721 A1 5/2001

* cited by examiner

*Primary Examiner*—Ren Yan
*Assistant Examiner*—Andrea H. Evans
(74) *Attorney, Agent, or Firm*—McGlew and Tuttle, P.C.

(57) ABSTRACT

A fanout compensator for a printing press, which comprises a rotary body formation, which has foot sections and head sections alternatingly next to each other along a longitudinal axis. The foot sections and head sections form a wave-shaped surface in order to deform a web to be printed on. The web wraps around the rotary body formation, in a wave-shaped pattern at right angles to the direction of conveying of the web. Fluid channels, which open on the surface of the rotary body formation, are formed in the rotary body formation. The rotary body formation has a fluid connection connected to the fluid channels in order to guide a pressurized fluid to the fluid channels and through the fluid channels to the surface of the rotary body formation.

21 Claims, 7 Drawing Sheets

FLUID-COATED FANOUT COMPENSATOR

FIELD OF THE INVENTION

The present invention pertains to the compensation of the fanout for affecting the width of a web, which is printed on in the printing press. The present invention pertains to both a fanout compensator and to a process for compensating the fanout. The fanout compensator may already be installed in the printing press or it may also be provided outside the printing press for installation for the purpose of fanout compensation. The printing press is a machine that prints according to the wet method, preferably with the use of a moistening agent. Offset printing shall be mentioned here as an example, in particular. The printing press may be a newspaper printing press for printing large newspaper runs. The web is preferably guided as an endless web through the machine and is wound off from a roll, i.e., the printing press is a web-fed printing press and especially preferably a web-fed rotary printing press in such an embodiment.

BACKGROUND OF THE INVENTION

Changes occur in lateral expansion in printing presses because of the liquid having penetrated the web. This phenomenon, known as fanout, has the undesired consequence that the width of the web measured at right angles to the direction of conveying of the web changes between two printing gaps in which the web is printed on one after another. Even though the fanout phenomenon may be caused, in principle, by the ink that alone has penetrated, the fanout is significant in practice especially in the case of printing operating with moistening agent because of the moistening of the web which is associated with it. The web moistened in the upstream printing gap along the web swells on its path and becomes wider in the next printing gap of the two printing gaps, which is located downstream along the web. This leads to printer's errors in the transverse direction of the web unless measures are taken to compensate the change in width.

EP 1 101 721 A1 shows devices for compensating the fanout for the web-fed rotary printing, with which the web is deformed in a wave-shaped pattern at right angles to its direction of conveying before it runs into a next printing gap, in which it is printed on. The width of the web is corrected, i.e., compensated in such a way that it is adapted in advance to the change in width that is to be expected based on the fanout. The present invention also pertains, in particular, to fanout compensators as they are known from EP 1 102 721 A1 and pertains, furthermore, especially also to the fanout compensation processes that can be embodied therewith.

SUMMARY OF THE INVENTION

The object of the present invention is to improve the fanout compensation; in particular, the fanout compensation shall not adversely affect the printing process.

The present invention pertains to the fanout compensation in a printing press by means of a fanout compensator, which comprises a rotary body formation, which is wrapped around by a web to be printed on. The wrapping angle should be at least 3°. A wrapping angle of 5° or more, e.g., 10°, is, however, preferred. The wrapping angle may reach up to 180°. A wave profile is imposed on the web by the rotary body formation at right angles to the direction of conveying because of the wrapping and the longitudinal tension of the web, which acts in the direction of conveying.

The width of the web is reduced by the imposition of the wave profile corresponding to the amplitude of the wave profile in order to compensate the increase in width caused by the fanout. In the best possible approximation, the web should have the same width in the two printing gaps located closest to the fanout compensator in the path of the web, i.e., in the printing gaps between which the fanout compensator is arranged.

According to the present invention, a fluid gap is generated between the surface of the rotary body formation and the web, so that the web has the smallest possible contact area and preferably no direct contact with the rotary body formation at all, but is located at a spaced location from the surface of the rotary body formation corresponding to the thickness of the fluid gap. Frictional forces acting on the web are thus minimized by the fanout compensation, and the longitudinal tension of the web between the printing gaps is advantageously changed much less than in the fanout compensators according to the state of the art. If the underside of the web facing the rotary body formation is printed on with printing ink, the risk that printing ink may be transferred from the underside of the web to the rotary body formation is reduced and, in the ideal case, eliminated.

The fanout compensator according to the present invention comprises a rotary body formation, which has foot sections and head sections, which alternate next to each other along its longitudinal axis and form a wave-shaped surface in order to deform the web to be printed on in a wave-shaped pattern at right angles to the direction of conveying of the web. The foot sections form the wave valleys and the head sections the wave peaks of a wave profile. Fluid channels, which open on the surface of the rotary body formation, are formed in the rotary body formation. The rotary body formation has, furthermore, at least one fluid connection, which is connected to the fluid channels and via which the fluid channels can be supplied with a pressurized fluid. The pressurized fluid introduced via the fluid connection into the fluid channels is guided by the fluid channels to the wave-shaped surface of the rotary body formation and is discharged under pressure on the surface at the opening sites, so that a fluid cushion in the form of the fluid gap is formed between the surface and the underside of the web.

The pressurized fluid is preferably a pressurized gas. Compressed air is especially preferred.

The opening sites of the fluid channels may be arranged distributed uniformly over the surface of the rotary body and uniformly in the circumferential direction. The density of the opening sites per unit area of the surface may, however, vary periodically with the period of the head and foot sections in the axial direction in case of a preferably uniform distribution in the circumferential direction. Thus, the surface density of the opening sites may be greater in the surface sections formed by the head sections than in the surface sections formed by the foot sections in order to compensate axial flows from the head sections into the foot sections.

The fluid channels may be formed as holes and extend from their opening sites on the surface through the head sections and/or foot sections of the rotary body formation radially inwardly into one cavity or optionally into a plurality of cavities, through which they can be or are connected to a fluid source. Such holes may be especially straight and unbranched. Holes may be drilled in the direct sense of the word or they may be prepared by another manner of processing, e.g., by means of laser.

Each of the fluid channels may be separated from each of the other fluid channels and form a single opening site.

However, the fluid channels or some of the fluid channels may also branch toward the surface of the rotary body formation and form a plurality of opening sites each there. There may also be cross connections between the fluid channels.

Providing the head sections and/or the foot sections of the rotary body formation with a porosity sufficient for the guiding of the fluid to obtain the fluid channels also corresponds to a preferred embodiment. The porosity is preferably an open porosity, so that the pores of the porous material, which are connected to one another, form the fluid channels. Especially original shaping by compression molding a powder, preferably a metal powder, with subsequent or simultaneous sintering of the molding, is especially suitable for forming porous head sections and/or foot sections. If the foot sections and/or the head sections form fluid channels due to material porosity, holes may also be prepared subsequently, so that the fluid channels are in their entirety partly pore channels and partly holes.

The head sections and foot sections may be formed separately and arranged alternatingly next to each other along the longitudinal axis. Thus, the head sections and the foot sections may be formed, e.g., by rollers, which are mounted rotatably around the longitudinal axis. The head sections may also be mounted rotatably around a common longitudinal axis and the foot sections may likewise be mounted rotatably around a common, other longitudinal axis, and the two longitudinal axes are themselves displaceable in parallel relative to one another for an adjustment of the wave profile of the rotary body formation, as is described especially in EP 1 101 721 A1. In such a design, the head sections and the foot sections would be mounted rotatably around a single, common hollow axle or around two hollow axles that are parallel to each other, through which the fluid can be fed.

However, not least based on the present invention, a rotary mounting of the head and foot sections may be eliminated altogether in such rotary body formations, whose wave profile acting on the web cannot be changed. In particular, it is not necessary for the rotary body formation to be freely rotatable. In particular, the rotary body formation does not have to follow the velocity of the web.

Rotary mounting of the rotary body formation is nevertheless advantageous, namely, to make it possible to adjust the wave profile formed by the surface of the rotary body formation. However, a rotary movement of the rotary body formation takes place in an especially preferred embodiment only for the purpose of adjustment, while the rotary body formation is stopped now in the state set optimally, i.e., is not rotating around its longitudinal axis. Insofar as the longitudinal axis will be called the axis of rotation below in the case of an adjustable rotary body formation, this may also designate, in principle, a rotary body formation mounted freely rotatably around the axis of rotation, but what is meant primarily is a rotary body formation that is rotated around its axis of rotation only for the purpose of adjusting the surface profile formed by it.

In a first embodiment, the rotary body formation is a one-piece rotary body with a rotationally symmetrical surface along the longitudinal axis. The wave profile of this rotary body is not changeable. Even though this rotary body may be mounted freely rotatably around its longitudinal axis, it is preferably mounted nonrotatably in the frame of the printing press. The term "rotary body" is related in the case of the nonrotatable mounting to the preferably round surface of the rotary body and especially preferably to, the surface of the rotary body that is rotationally symmetrical around the longitudinal axis.

In a preferred second embodiment, a rotary body, which forms alternatingly the radially projecting head sections and the radially set-back foot sections next to each other along the longitudinal axis, likewise in one piece, is mounted rotatably around the longitudinal axis in order to change the wave profile formed by the head and foot sections. The features of the one-piece design and adjustability are combined in the second embodiment due to the radial height differences existing between the head sections and the foot sections increasing in the circumferential direction around the axis of rotation from minima, which they have along a first straight line offset in parallel to the axis of rotation, to maxima. The radial height differences have the maxima along a second straight line offset in parallel to the axis of rotation. The first straight line and the second straight line are preferably tangents to all head sections, namely, if all head sections have the same radial height in relation to the axis of rotation. If this is not the case, the two straight lines are the respective tangents to the head section projecting farthest or to the group of head sections projecting farthest. A rotary movement around the axis of rotation, which is uniform for the entire rotary body, is sufficient for the adjustment of the rotary body.

A rotary body according to the second embodiment can also be mounted in a simple manner in the printing press and can be mounted rotatably in the same manner as other rotary bodies of the printing press, e.g., deflecting rollers.

Even though a single, one-piece rotary body preferably forms the entire rotary body formation of the fanout compensator in the first and second embodiments, it shall not be ruled out that a few such rotary bodies, especially two or three rotary bodies or even head and foot sections connected in a torsion-proof manner are arranged next to each other along a common longitudinal axis, which coincides with the axis of rotation in the second embodiment.

The surface of the rotary body formation acting on the web is preferably rounded everywhere in the circumferential direction. The surface may form a circle for this purpose along the longitudinal axis of the rotary body formation, especially everywhere. The surface sections formed by the head sections are preferably arched in a round form radially outwardly in relation to the longitudinal axis, and the surface sections formed by the foot sections are arched in a round form radially inwardly in relation to the longitudinal axis. This is preferably true everywhere over the circumference of the rotary body formation. Furthermore, the head and foot sections should pass over into one another softly on the surface, i.e., they shall be continuously differentiable in the axial direction at the transition sites by passing tangentially over into one another.

Corresponding to a design that is likewise preferred because of its simple manufacturability, the surface sections formed by the head sections are straight in the axial direction over part of their length or over their entire length. The transition sites between the surface sections formed by the foot sections and the head sections should, however, pass softly over into one another over the circumference of the rotary body in this design as well.

A rotary body formation from head sections and foot sections, which are nonrotatable in relation to one another and all or some are formed in preferred embodiments from one or a few rotary bodies in one piece, considerably facilitates the supply of the surface with the pressurized fluid. While a separate rotary fluid connection must be created for each of these head and foot sections in the case of individually rotatably mounted head and foot sections, a common connection is sufficient for the head and foot sections that are not rotatable in relation to one another. Such a connection is preferably created by a hollow axle, on which the head and foot sections that are not rotatable in relation to one another are mounted.

In the case of a nonadjustable rotary body formation, the head and foot sections may be formed each separately and fastened nonrotatably on the hollow axle. However, the head and foot sections are preferably formed in this case in a rotary body in one piece, which has a cavity, e.g., a central hole, of a sufficient length inside in order to supply the entire active surface of the rotary body with the fluid. In an especially preferred second embodiment, in which the wave profile of the rotary body formation acting on the web is changeable, a rotary body, which forms all or some of the head or foot sections in one piece, may be mounted rotatably on the hollow axle. As an alternative, the hollow axle may be replaced by a hollow shaft, i.e., the rotary body forms the bearing journal or the bearing journals for its rotary mounting itself. However, the rotary mounting of the rotary body on a hollow axle, which is mounted itself nonrotatably in the frame of the printing press, is preferred. One advantage of the rotary mounting on a hollow axle is that fluid supply can thus be limited in a simple manner to the part of the waved-shaped surface related to the circumferential direction, which acts on the web.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
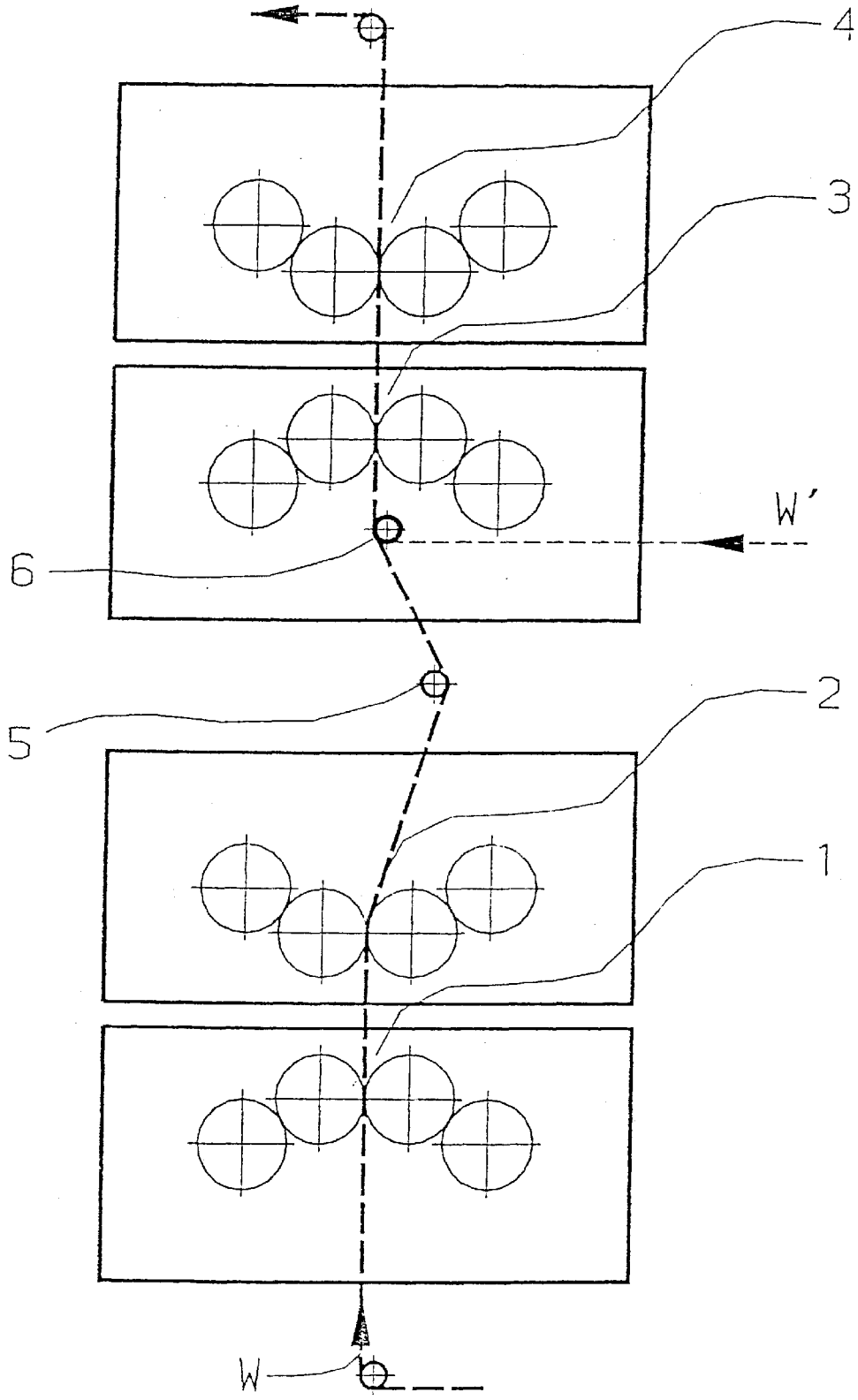
FIG. 1 is a schematic view showing a printing tower with a rotary body according to the present invention.

Referring to the drawings in particular, FIG. 1 shows an eight-up tower with four printing couples. The four printing couples are arranged in the printing tower one on top of another in two H bridges. Each of the printing couples comprises two rubber blanket cylinders and two plate cylinders, i.e., a plate cylinder each for one of the rubber blanket cylinders. The rubber blanket cylinders form between them printing gaps 1 through 4, through which a web W is conveyed and is printed on on both sides by the rubber blanket cylinders pressing them. An intake roller is arranged in the known manner in front of the printing couple that is the first printing couple in the direction of conveying, and a discharge roller is arranged in the known manner behind the printing couple that is the last printing couple in the direction of conveying, and the rollers may be designed as draw rollers in order to set a certain web tension.

The web W is printed on according to the wet offset method. The web W now takes up moisture and swells. Without corrective measures, the web width measured at right angles to the direction of conveying of the web W would increase from one printing gap to the next, and the prints printed one after another in the printing gaps 1 through 4 would not fit each other in the transverse direction of the web, i.e., register mark errors would develop in the transverse direction. This phenomenon is called "fanout." The increase in width would be greatest between the two H bridges, i.e., between the printing gaps 2 and 3, because the path from gap to gap is longer there than between two printing gaps of one bridge.

To prevent or at least reduce register mark errors in the transverse direction, the web width is reduced on the path of the web W from the printing gap 2 to the printing gap 3 directly following it in the printing run being shown. A fanout compensator is arranged for this purpose between the printing gaps 2 and 3. The fanout compensator comprises a rotary body 6, which may also be used as a deflecting roller at the same time. The rotary body 6 is arranged directly in front of the printing gap 3 and also assumes the straight guiding function for the web W in this arrangement, so that the web W runs into the printing gap 3 without wrapping.

FIG. 1 also indicates an alternative print position, in which the web W is guided only through the two lower printing gaps 1 and 2, while another web W' is guided over the rotary body 6 and runs straight into the next printing gap 3 after deflection.

The rotary body 6 is roller-shaped, but, unlike a simple, smooth roller, it has a surface waved in the longitudinal direction. Wrapping and the web tension ensure that the web is deformed corresponding to the surface wave pattern of the rotary body 6 and the width of the web is reduced as a result. The wrapping around the rotary body 6 is ensured by a deflecting roller 5, via which the web W is guided to the rotary body 6 at an angle to the straight connection line between the rotary body 6 and the next printing gap 3. Additional deflecting means are not necessary in the alternative print run, in which the web W' already runs at an angle to this straight connection line and the rotary body 6 also acts as a deflecting roller in a dual function.

Figure 2:
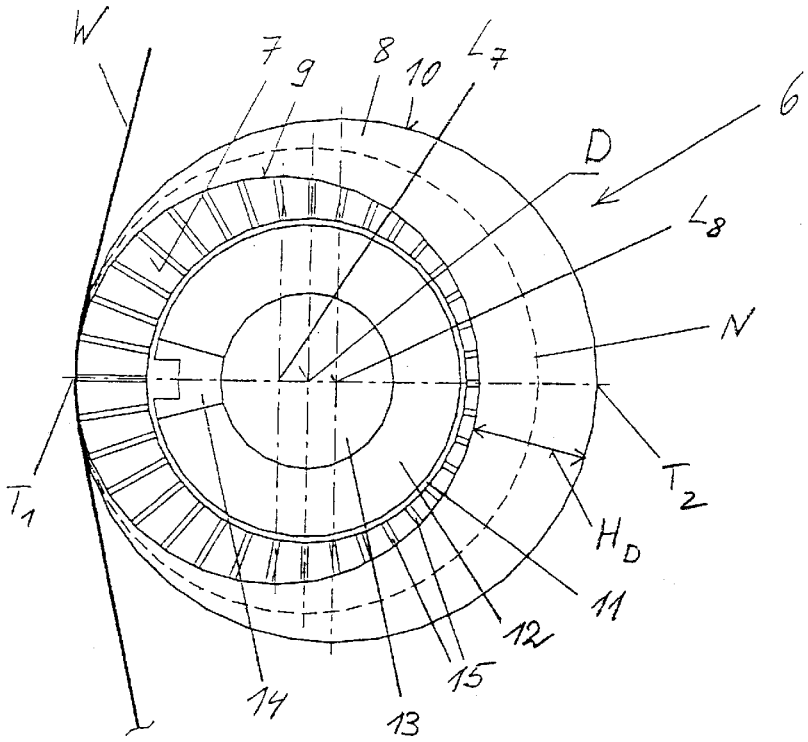
FIG. 2 is a cross sectional view of the rotary body according to a first exemplary embodiment in a first angle of rotation position.
Figure 3:
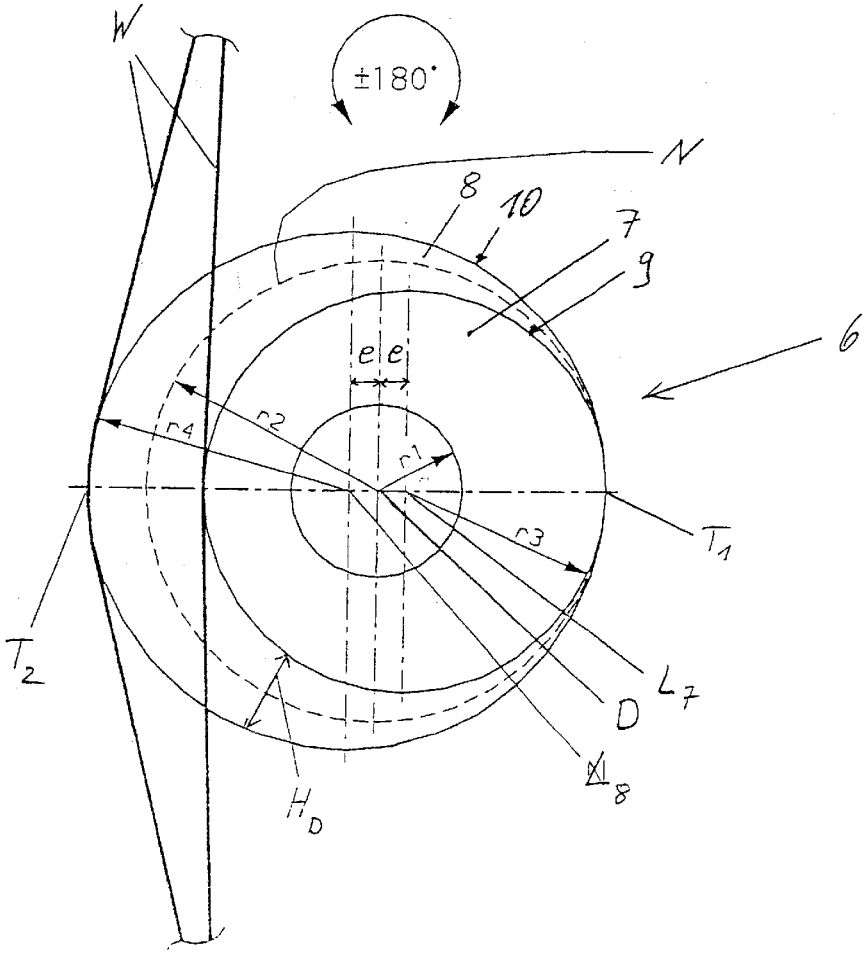
FIG. 3 is a cross sectional view of the rotary body in a second angle of rotation position.
Figure 4A:
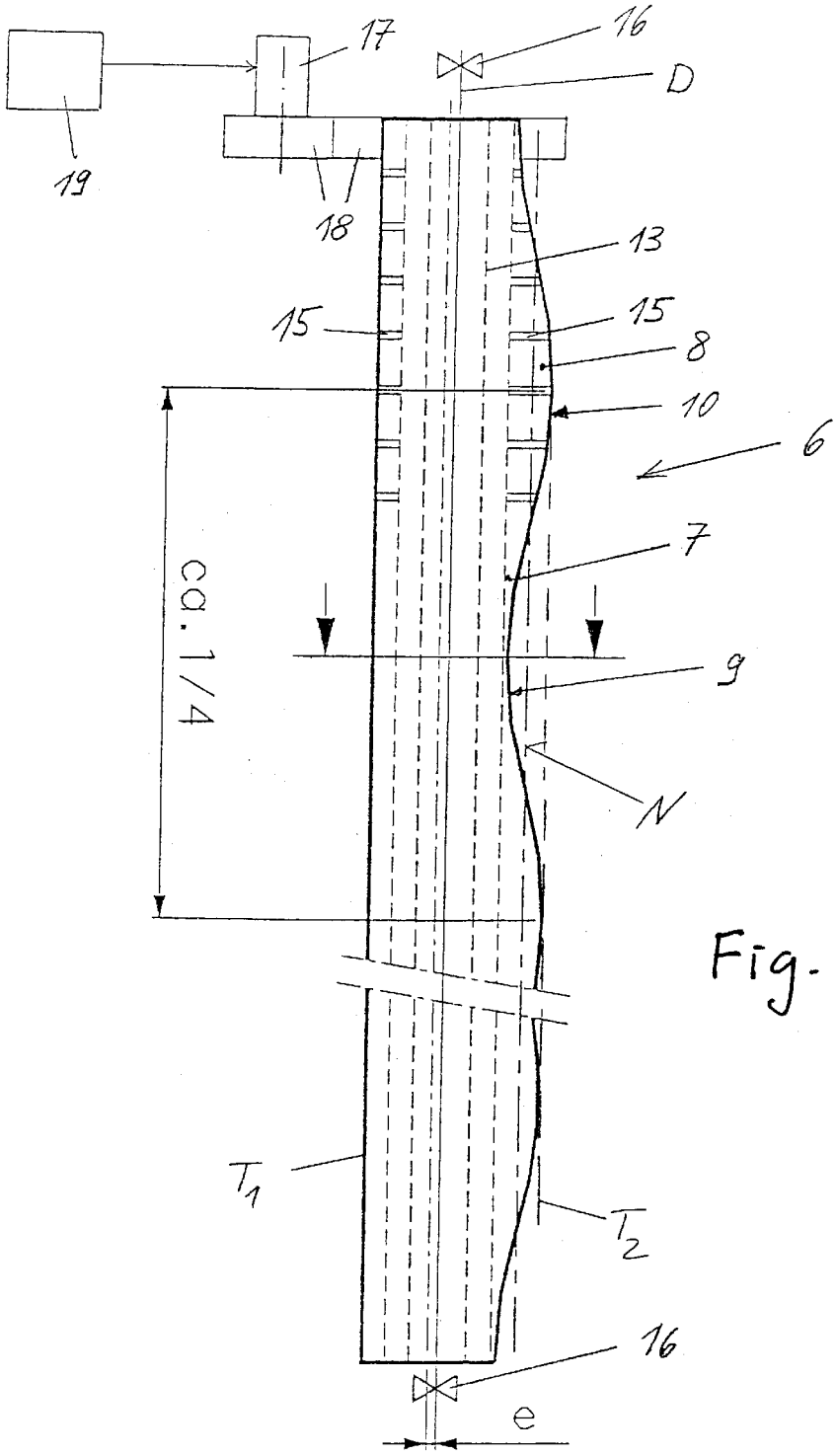
FIG. 4A is a longitudinal view and a partial longitudinal sectional view of the rotary body.
Figure 4B:
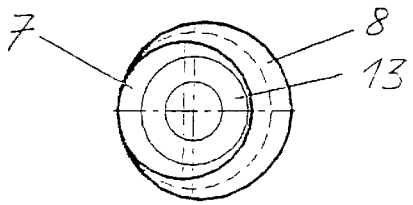
FIG. 4B is a cross sectional view of the rotary body.

FIGS. 2 and 3 show a first exemplary embodiment of the rotary body 6 in identical cross sections but in two extreme angle of rotation positions. FIG. 4 shows the rotary body in a longitudinal view and partially in a longitudinal section.

The rotary body 6 is mounted in a frame of the printing press rotatably around a longitudinal axis D. The longitudinal axis D is therefore hereinafter called the axis of rotation. The rotary body 6 is shaped in one piece according to an original shaping or forming process, e.g., drop-forging, and fine machined on the surface, preferably only subjected to uniform smoothing. The rotary body 6 as a whole is not rotationally symmetrical in relation to the axis of rotation D.

As can be recognized from viewing FIGS. 2 through 4 together, the surface of the rotary body 6 forms a straight line $T_1$ parallel to the axis of rotation D at a single value of an angle of rotation around the axis of rotation D. At all other angles of rotation, the surface has a wave shape with a sinusoidal wave contour rounded uniformly in the axial direction. The axial sections of the rotary body 6 that form the wave valleys will hereinafter be called foot sections 7 and the axial sections that form wave peaks will hereinafter be called head sections 8. Beginning from the straight line $T_1$, the radial height difference $H_D$ of the wave contour increases continuously in the circumferential direction around the axis of rotation D in both directions of rotation up to a second straight line $T_2$. The straight lines $T_1$ and $T_2$ are located diametrically opposite each other in relation to the axis of rotation D, i.e., the straight lines $T_1$ and $T_2$ extend in one plane with the axis of rotation D. The radial height difference $H_D$ is the amplitude of the wave contour. The radial height differences $H_D$ amount to 4 mm along the second straight line $T_2$. These maximum height differences, which are equal in the exemplary embodiment, should be at least 2 mm and at most 10 mm.

The straight lines $T_1$ and $T_2$ are tangents to the head sections 8, i.e., they touch the head sections 8 precisely in their apices. They originate from a straight enveloping cylinder enveloping the head sections 8. If the tangent $T_1$ to the surface of the enveloping cylinder is displaced in parallel, the height difference $H_D$, which is measured radially to the axis of rotation D between the apices of the foot sections 7 and the apices of the head sections 8, increases continuously until the tangent $T_2$ is reached.

A regular cylinder jacket surface N, behind which the foot sections 7 are set back radially and over which the head sections 8 project radially, is also shown in FIGS. 2 through 4. The cylinder surface N divides the surface profile in each longitudinal section into the foot sections 7 and the head sections 8.

The foot sections 7 form surface sections 9, and the head sections 8 form surface sections 10. The surface sections 9 and 10 are rounded in the axial direction and in the circumferential direction, and they are preferably curved continuously everywhere. They run tangentially into one another in the cylinder surface N, so that a uniform wave shape with continuous, i.e., continuously differentiable transitions between the surface sections 9 and 10, is obtained everywhere in the axial direction.

The surface of the rotary body 6 forms a circle in the cross section everywhere along the axis of rotation D. In FIG. 3, the radius of the circle is designated by $r_3$ in the apices of the foot sections 7 and by $r_4$ in the apices of the head sections 8. The central axes of these azimuths, which are designated by $L_7$ and $L_8$, are eccentric to the axis of rotation D with the eccentricity "e." The central axes $L_7$ and $L_8$ extend in the same plane as the axis of rotation D. The central axes of the cross section circles of the foot sections 7 and also the central axes of the cross section circles of the head sections 8 gradually migrate in the direction of the axis of rotation D with the approach to the neutral cylinder surface N to coincide with the axis of rotation D at the transition sites on the neutral cylinder surface N.

It should also be noted in regard to the neutral cylinder surface N and the radial height difference $H_D$ that the arcs formed by the surface sections 8 along each of the straight lines of the neutral cylinder surface N, which straight lines are parallel to the axis of rotation D, are exactly as long as the arcs formed by the surface sections 10. These arcs of the surface sections 8 and 9 are especially preferably equal when the arcs of the surface sections 8 are folded to the side of the respective straight line of the cylinder surface N on which side the arcs of the surface sections 10 extend. This is the case in the exemplary embodiment. The tangent $T_1$, along which the radial height difference $H_D$ has the value "0," extends in the neutral cylinder jacket surface N. As a result, a mean web path does not change when the rotary body 6 performs a rotary adjusting movement around the stationary axis of rotation D, e.g., from the angle of rotation position of minimum waviness shown in FIG. 2 into the angle of rotation position of maximum waviness shown in FIG. 3. In each angle of rotation position of the rotary body 6, the mean path of the web W extends on the neutral cylinder surface N, which is called "neutral" for this reason.

The rotary body 6 is a hollow body with a central, regular cylindrical hole 11 extending over its entire length. A hollow axle 12 fastened nonrotatably to the machine frame extends through the hole. The rotary body 6 is mounted rotatably on the hollow axle 12 around the axis of rotation D. The fixed mounting of the hollow axle 12 is designated by 16 in FIG. 4. The rotary adjusting movement of the rotary body 6 in relation to the hollow axle 12 is brought about by a motor by means of an electric motor 17, which rotates the rotary body 6 via a reducing gear mechanism 18. The motor 17 is the final control element of a control 19, which controls the final control element 17 for the adjustment of the rotary body 6, e.g., as described in EP 1 101 721 A1, to which reference is made here in this respect.

The rotary body 6 is adjusted rotatingly only for the purpose of adjustment, i.e., to change its surface contour acting on the web W. It is otherwise locked by the final control element 17 in the current print run via the gear mechanism 18.

A central, axial hole 13, which is used to feed compressed air to the rotary body 6, is formed continuously in the hollow axle 12. Furthermore, the hollow axle has a longitudinal opening 14. The rotary body 6 is provided with fluid channels 15, which extend radially through the ring jacket of the rotary body 6. Each of the fluid channels 15 is formed as a straight through hole, which extends into the inner cavity formed by the hole 11 and opens on the outer jacket surface of the rotary body 6, i.e., on the surface of the rotary body. The fluid channels 15 are arranged in a uniformly distributed pattern around the axis of rotation D of the rotary body 6 in the circumferential direction. They may be prepared in the ring jacket of the rotary body 6 by means of, e.g., a laser. The fluid channels 15 are also arranged in a uniformly distributed pattern along the axis of rotation D.

The fluid channels 15 are connected to a compressed air source via the hollow axle 12. The compressed air is introduced into the hole 13 of the hollow axle 12 and reaches the hole 11 and the fluid channels 15 via the longitudinal opening 14. The longitudinal opening 14 extends over a length that is sufficient to supply the fluid channels 15 with the compressed air uniformly over the entire axial length of the wave contour. The longitudinal opening 14 is widened from the hole 13 toward the outer jacket surface of the hollow axle 12 and covers a plurality of fluid channels 15 in the circumferential direction. It opens and widens in the direction of the underside of the wrapping web W. The compressed air thus reaches the area under the fluid channels 15, which are covered by the web W, directly radially through the hole 13 and the longitudinal opening 14. An annular gap formed between the hollow axle 12 and the inner jacket surface of the rotary body 6 preferably forms a sealing gap in order to minimize the loss of compressed air due to leakage.

Figure 5:
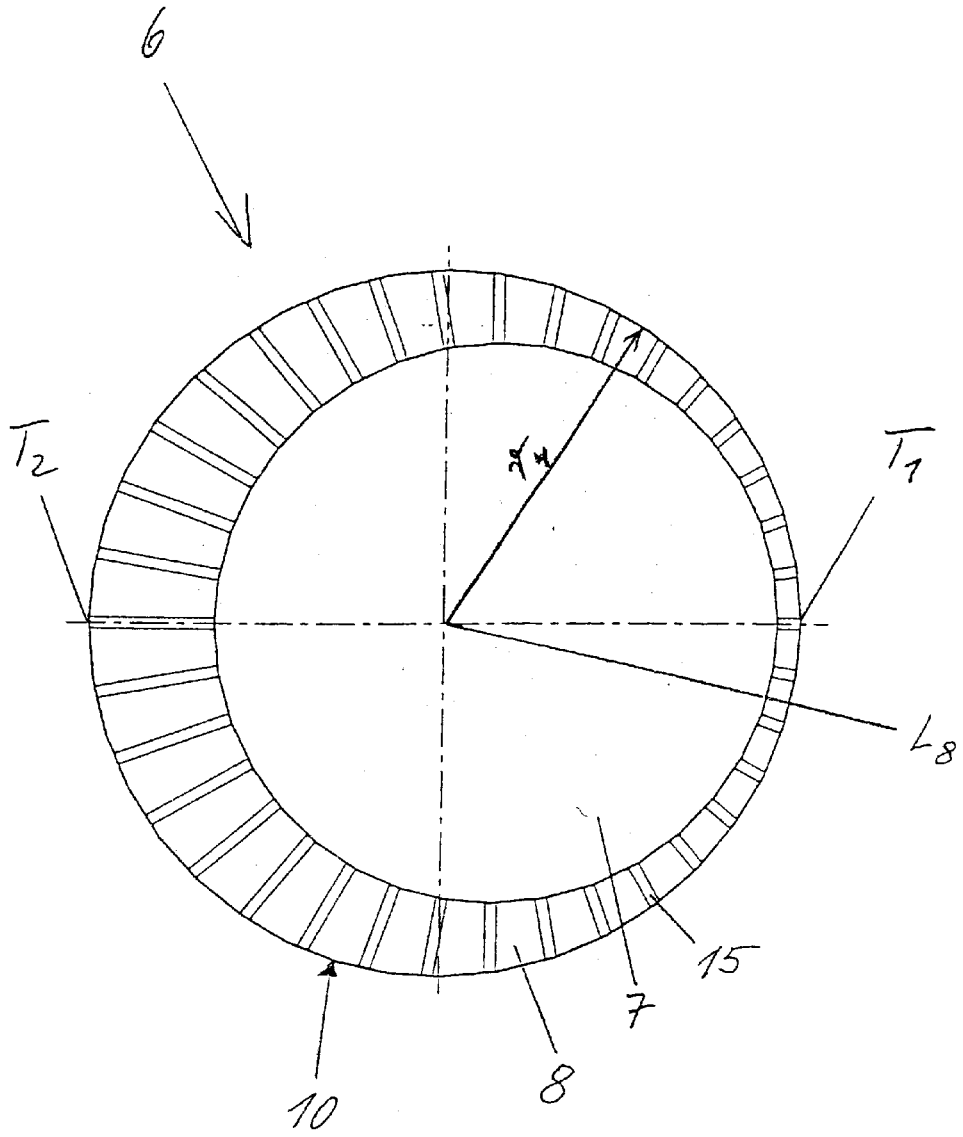
FIG. 5 is a cross sectional view through the apex of a head section of the rotary body.

Because of the cross-sectional plane selected, fluid channels 15 are shown in FIG. 2 only in the foot section 7 of the corresponding cross section. Fluid channels 15 are, of course, formed especially in the head sections 8, as can be recognized in the cross section through the apex of a head section 8 in FIG. 5.

Figure 6:
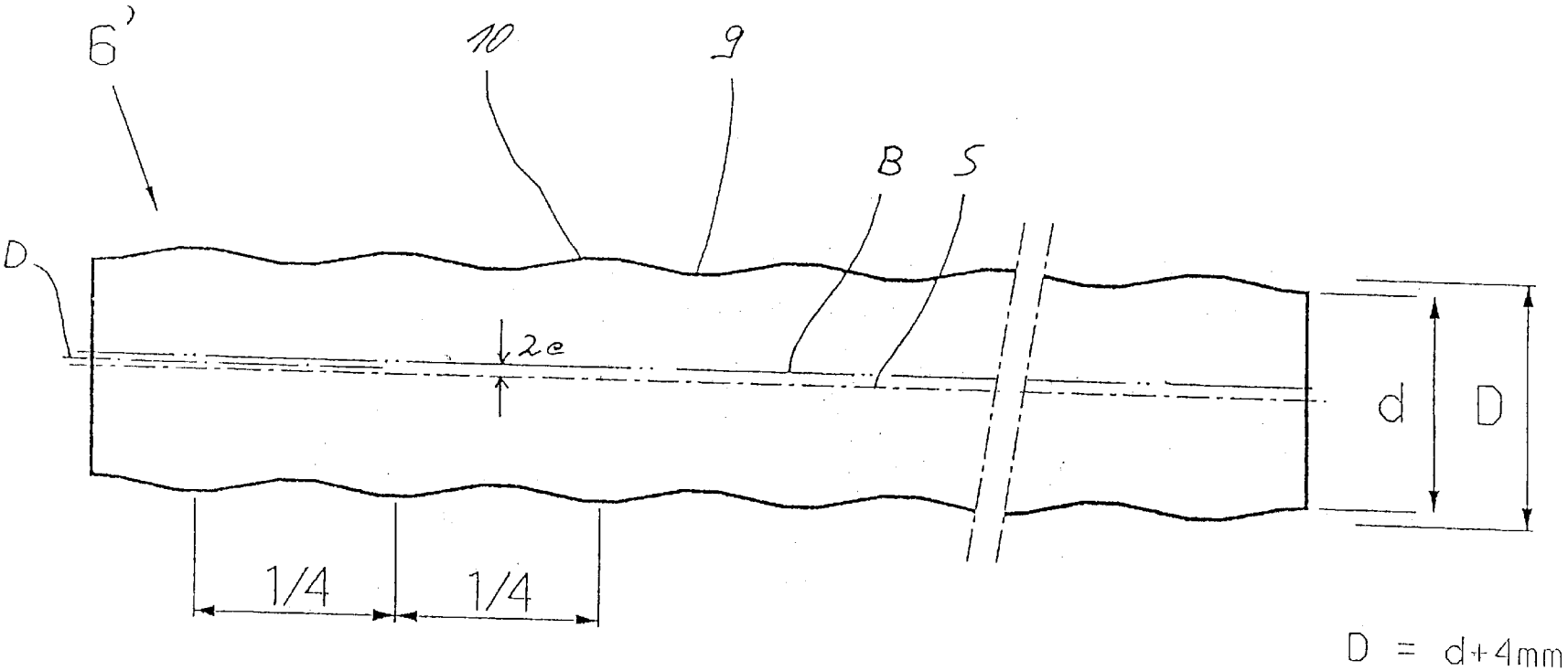
FIG. 6 is side view of a starting body, from which a rotary body according to a second exemplary embodiment is formed by material-removing machining.
Figures 11, 12, 13, 14:
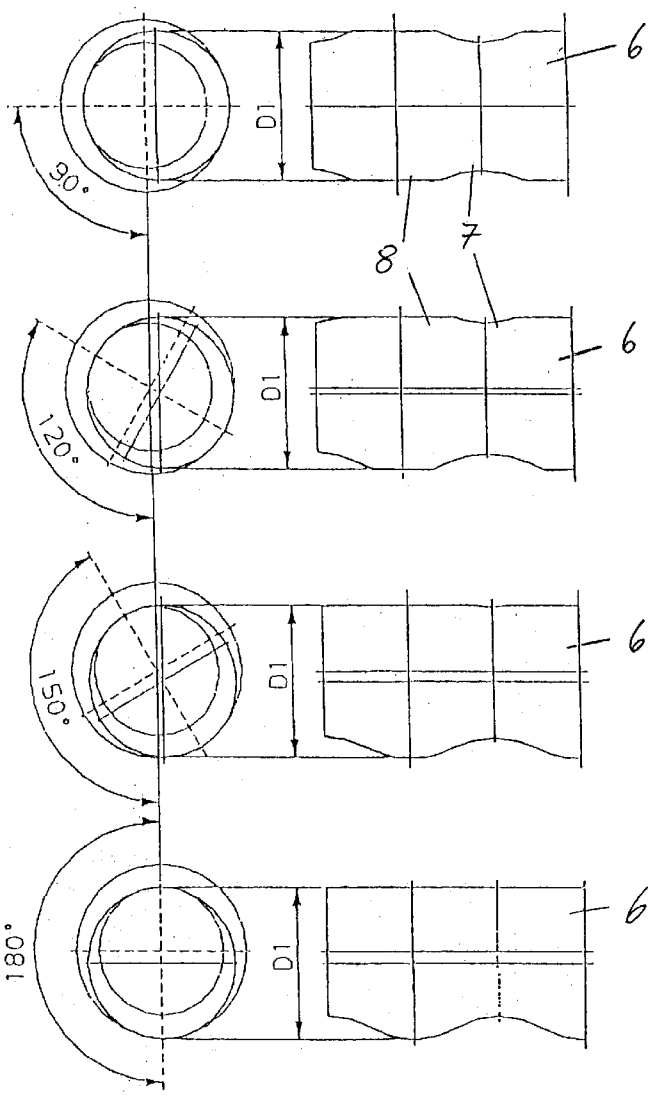
FIG. 11 is a composite end view and partial side view showing the rotary body of the second exemplary embodiment in an angular position rotated 90° relative to FIG. 7.
FIG. 12 is a composite end view and partial side view showing the rotary body of the second exemplary embodiment in an angular position rotated 120° relative to FIG. 7.
FIG. 13 is a composite end view and partial side view showing the rotary body of the second exemplary embodiment in an angular position rotated 150° relative to FIG. 7.
FIG. 14 is a composite end view and partial side view showing the rotary body of the second exemplary embodiment in an angular position rotated 180° relative to FIG. 7.
Figures 7, 8, 9, 10:
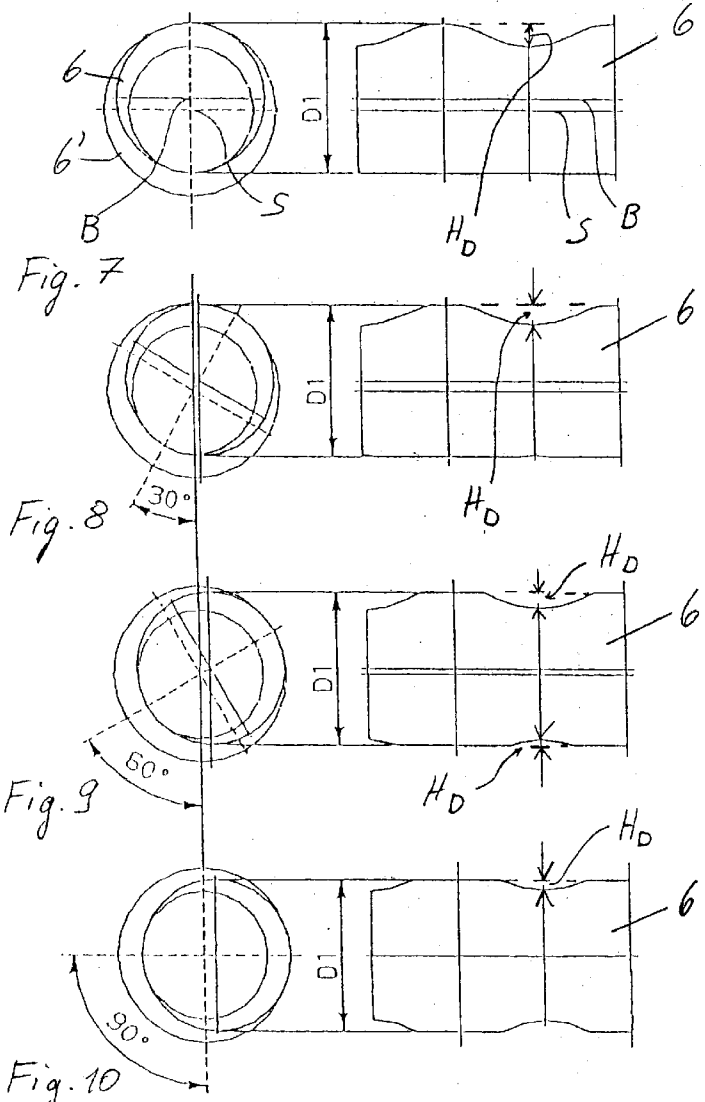
FIG. 7 is a composite end view and partial side view showing the rotary body of the second exemplary embodiment in an angular position.
FIG. 8 is a composite end view and partial side view showing the rotary body of the second exemplary embodiment in an angular position rotated 30° relative to FIG. 7.
FIG. 9 is a composite end view and partial side view showing the rotary body of the second exemplary embodiment in an angular position rotated 60° relative to FIG. 7.
FIG. 10 is a composite end view and partial side view showing the rotary body of the second exemplary embodiment in an angular position rotated 90° relative to FIG. 7.

FIGS. 7 through 14 show a rotary body 6 of a second exemplary embodiment, which was obtained by machining from a starting body 6', which is rotationally symmetrical around its longitudinal axis and is shown in FIG. 6. FIGS. 7 through 14 show a view each of a front side of this rotary body 6 and a view of its longitudinal side. Based on FIG. 7, the figures show the rotary body 6 in a succession of angle of rotation positions, in which the rotary body 6 is rotated by 180° in increments of 30° from the first position shown in FIG. 7 into the position shown in FIG. 14. However, the angle of rotation position is the same in FIGS. 10 and 11.

FIG. 6 shows a starting body 6', which is rotationally symmetrical in relation to the axis of rotation D and from which the adjustable rotary body 6 of the second exemplary embodiment was manufactured. The starting body 6' has the same, regular wave contour on its surface everywhere along its axis of symmetry S. It may be obtained, e.g., by compression molding and sintering. It may also be obtained from a regular cylindrical casting by material-removing machining. The starting body 6' can be obtained by machining by clamping the previously smooth cylinder casting with its symmetry axis S as the axis of rotation into a lathe and by axially displacing a turning tool of the lathe along a template corresponding to the wave contour and forming the wave form as a result.

The starting body 6' thus obtained is clamped in a subsequent operation rotatably around a machining axis B offset in parallel to the symmetry axis S. The symmetry axis S is the central axis $L_7$ through the azimuths of the foot sections 7, and the machining axis B is the central axis $L_8$ through the azimuths of the head sections 8. The machining axis B therefore has an eccentricity "2e" compared with the symmetry axis S of the starting body 6'. The starting body 6' is subsequently rotated around the machining axis B. At the same time, the turning tool is displaced axially in a straight line along the machining axis B and moved toward the machining axis B, so that the asymmetrical, adjustable rotary body 6 is obtained after the hole 11 has been prepared.

FIG. 6 shows as an example the pitch of the wave contour of the starting body 6'. The pitch is the distance between two apices of the head sections 8 arranged next to each other, and of course, likewise the axial distance between two apices of the foot sections 7 arranged next to each other, the distances being measured in the axial direction. This distance or the pitch equals one fourth of the width of a printing form being used in the current print run, which said width is measured in the axial direction. The wave contour of the rotary body 6, which was obtained from the starting body 6', is, of course, likewise one fourth of the width of the printing form.

The wave form of the rotary body 6 visible in FIGS. 7 through 14 is obtained because of the manufacturing process. The rotary body 6 according to the second exemplary embodiment has a wave contour that is uniformly round everywhere in the axial direction only along a single straight line, along which the radial height differences $H_D$ have their maxima. The wave contour with the maxima of the radial height differences $H_D$ can be recognized in the longitudinal views in FIGS. 7 and 14. A single, exact straight line, at which the minima of the radial height differences $H_D$ are consequently again "zero," is formed in a diametrically opposite location. Over the circumference between these two straight lines, the wave contours have straight plateaus in the axial direction in the apical areas of the head sections 8, as can be readily recognized from FIGS. 8 through 13. The two inner circles shown in the front views in FIGS. 7 through 14 are the azimuth of the foot sections 7, on the one hand, and the azimuth of the head sections 8, on the other hand. All the cross sections that are located in the axial direction between the azimuths of the foot sections 7 and the azimuths of the head sections 8 deviate from the circular shape corresponding to the manufacturing process. The transitions between the straight plateaus of the head sections 8 and the round, convex foot sections 7 are made round by machining preferably in the circumferential direction by fine surface finishing, e.g., by grinding and polishing.

The fluid channels 15 may have been prepared first only in the asymmetric rotary body 6. Furthermore, they may be prepared in the starting body 6' after the starting body 6' has been prepared, or, finally, they may also have been prepared already in the straight cylindrical, smooth casting as an alternative, if the starting body 6' was prepared, for example, from such a body. The starting body 6' may have been also obtained, instead, e.g., by pressing and sintering and already form the fluid channels as pore channels based on a material porosity set correspondingly.

The formation of a fluid cushion between the web and the surface of the rotary body is already highly advantageous in a rotationally symmetrical rotary body, as can be formed by the starting body 6'.

Figure 15:
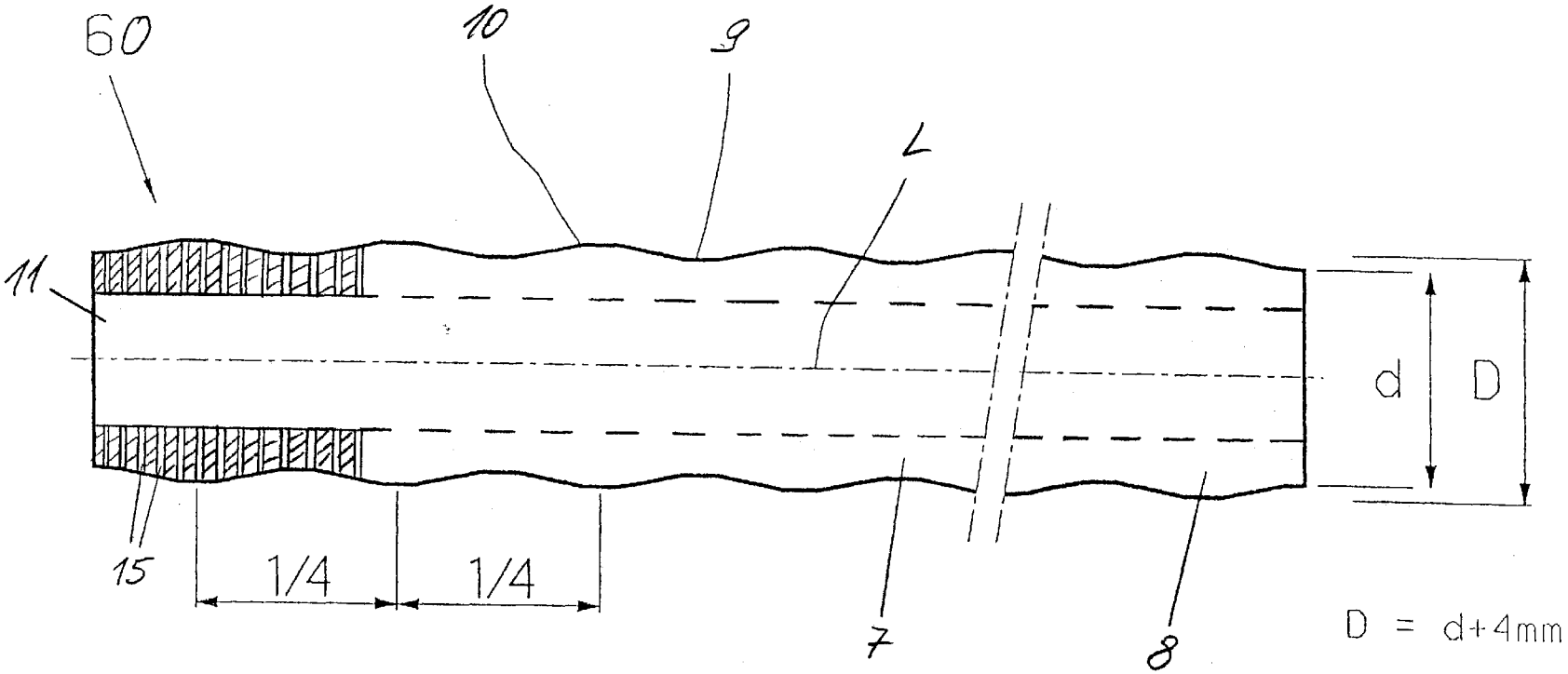
FIG. 15 is a longitudinal view and a partial longitudinal section of a rotary body of a third, simplified embodiment.

FIG. 15 shows such a rotary body, which is designated by the reference number 60 for distinction.

The shape and the arrangement of the fluid channels 15 in the longitudinal direction and in the circumferential direction of the rotary body 60 may be the same as in the adjustable rotary body 6. The rotary body 60 may be mounted rotatably in order to reduce the friction with the wrapping web. However, it is also fully sufficient and even preferred for the rotary body 60 not to be mounted rotatably in the machine frame. The symmetry and longitudinal axis is therefore designated with L rather than with D for distinction from an axis of rotation. However, the same reference numbers are otherwise used as for the adjustable rotary body 6.

The formation of an air cushion or cushion from another gas is, furthermore, advantageous not only in connection with a one-piece rotary body 6 or 60, but also in the case of a rotary body formation made from a plurality of rollers arranged axially next to each other and, in principle, in other embodiments of rotary bodies as well. Concerning such other embodiments, which may be adjustable or nonadjustable but have the fluid admission to the surface of the rotary body according to the present invention, again refer to EP 1 101 721 A1, to which reference is also made in this respect. However, the embodiments made of one-piece rotary bodies or multipart rotary body formations described there would have to be provided with fluid channels and a fluid connection for the fluid channels in the jacket of the rotary body or in the jackets of the plurality of rotary bodies of a rotary body formation.

While specific embodiments of the invention have been shown and described in detail to illustrate the application of the principles of the invention, it will be understood that the invention may be embodied otherwise without departing from such principles.

What is claimed is:

1. A fanout compensator for a printing press, the compensator comprising:

a rotary body formation with foot sections and head sections arranged alternatingly adjacent to one another along a longitudinal axis, said foot sections and said head sections forming a wave-shaped surface to deform a web to be printed on, which wraps around the rotary body formation, in a wave-shaped pattern at right angles to a direction of conveying of the web, said rotary body formation having fluid channels opening on said surface of said rotary body formation and formed in the rotary body formation; and wherein the rotary body formation has an inner cavity, said fluid channels opening into said inner cavity; and a fluid connection associated with said rotary body formation and connected to said fluid channels to guide a pressurized fluid to said fluid channels and through said fluid channels to said surface of said rotary body formation.

2. A fanout compensator in accordance with claim 1, wherein all said fluid channels or some of the fluid channels are holes.

3. A fanout compensator in accordance with claim 1, wherein the rotary body formation is porous and the fluid channels are formed by the porosity of the material.

4. A fanout compensator in accordance with claim 1, further comprising a hollow axle or hollow shaft, said rotary body formation being mounted rotatably on said hollow axle or being fastened to said hollow shaft secured against rotation, and said hollow axle or said hollow shaft forms one or more fluid feed channels feeding fluid to said fluid channels through said hollow axle or said hollow shaft.

5. A fanout compensator in accordance with claim 4, wherein said hollow axle or hollow shaft includes a perforated jacket with longitudinal openings that open in a radial direction directly to a strip-shaped area of the rotary body formation, said strip-shaped area extending in a longitudinal direction and being passed through by said fluid channels in the radial direction.

6. A fanout compensator in accordance with claim 1, wherein said foot sections and said head sections are not rotatable in relation to one another around the longitudinal axis of the rotary body formation.

7. A fanout compensator in accordance with claim 6, wherein said rotary body formation comprises said foot sections and said head sections formed in one piece.

8. A fanout compensator in accordance with claim 1, wherein said head sections project over said foot sections by radial height differences and said radial height differences increase in a circumferential direction from minima that are along a first straight tangent line offset in parallel to the longitudinal axis to maxima, which are along a second straight tangent line offset in parallel to the longitudinal axis.

9. A fanout compensator in accordance with claim 8, wherein the minima are all equal, preferably zero.

10. A fanout compensator in accordance with claim 8, wherein the maxima are all equal.

11. A fanout compensator in accordance with claim 1, wherein the foot sections form radially outwardly concave surface sections continuously differentiable in the axial direction.

12. A fanout compensator in accordance with claim 1, wherein the head sections form radially inwardly concave surface sections continuously differentiable in the axial direction.

13. A fanout compensator in accordance with claim 8 wherein the radial height differences change in the circumferential direction around the longitudinal axis and are continuously differentiable in the circumferential direction around the longitudinal axis.

14. A fanout compensator in accordance with claim 8, wherein the radial height differences which change in the circumferential direction around the longitudinal axis are equal along said tangents which touch the head sections and are parallel to the longitudinal axis.

15. A fanout compensator in accordance with claim 1, wherein the foot sections and the head sections form surface sections which meet each other on a neutral regular cylinder jacket surface and the longitudinal axis of the rotary body formation is a central longitudinal axis of the neutral regular cylinder jacket surface.

16. A fanout compensator in accordance with claim 1, wherein the foot sections form arcs of a surface wave contour of the rotary body radially under a neutral regular cylinder jacket surface and the head sections form arcs of a surface wave contour of the rotary body formation radially above the neutral regular cylinder jacket surface in the axial direction, and the arcs formed by the foot sections have the same shape in each axial section of the rotary body formation, which axial section encloses the axis of rotation, as the arcs formed by the head sections when the arcs formed by the foot sections are folded to the side of the arcs formed by the head sections.

17. A fanout compensator in accordance with claim 1, wherein the rotary body formation is arranged in a printing press between a printing gap arranged upstream and a printing gap arranged downstream, in which the web passing through in a print run is printed on one after another, on one side of the web and which are wrapped by the web.

18. A fanout compensator in accordance with claim 1, further comprising a final control element wherein the rotary body formation is connected to said final control element of a control and regulating means for the controlled or regulated rotary adjusting movement of the rotary body formation around the longitudinal axis.

19. A fanout compensator in accordance with claim 1, further comprising a printing press frame wherein the rotary body formation is fastened in said printing press frame nonrotatably around the longitudinal axis.

20. A fanout compensator in accordance with claim 19, wherein the rotary body formation is rotationally symmetrical in relation to the longitudinal axis.

21. A process for compensating the fanout in a printing press, the process comprising:

printing a web with printing ink and moistened with a moistening agent in a first printing gap and subsequently printing in a second printing gap;

wrapping the web around a rotary body formation between the first printing gap and the second printing gap wherein the rotary body formation is wave-shaped at right angles to a direction of conveying of the web so that the web is deformed in a wave-shaped pattern at right angles to the direction of conveying; and said rotary body formation having fluid channels opening on said surface of said rotary body formation and formed in the rotary body formation; wherein the rotary body formation has an inner cavity, said fluid channels opening into said inner cavity; and discharging a pressurized fluid on the surface of the rotary body formation and admitting the fluid to the web during the wrapping on its underside facing the rotary body formation so that a fluid gap is generated and maintained between the wave-shaped surface of the rotary body formation and the web.

* * * * *